United States Patent [19]

Yokoyama

[11] 4,366,416

[45] Dec. 28, 1982

[54] FLUORESCENT LAMP DEVICE

[75] Inventor: Nobuo Yokoyama, Yokohama, Japan

[73] Assignee: Tokyo Shibaura Denki Kabushiki Kaisha, Kawasaki, Japan

[21] Appl. No.: 246,011

[22] Filed: Mar. 20, 1981

[30] Foreign Application Priority Data

Apr. 2, 1980 [JP] Japan ..... 55-43019
Apr. 2, 1980 [JP] Japan ..... 55-43020

[51] Int. Cl.[3] ..... H05B 41/16

[52] U.S. Cl. ..... 315/58; 315/71; 315/309; 315/DIG. 5

[58] Field of Search ..... 315/51, 58, 71, 309, 315/DIG. 5; 362/154, 222, 223, 316, 362

[56] References Cited

U.S. PATENT DOCUMENTS 3,953,761 4/1976 Giudice ..... 315/71
4,270,071 5/1981 Morton ..... 315/58 X
4,316,121 2/1982 Hammer et al. ..... 315/71 X

FOREIGN PATENT DOCUMENTS 47-10150 4/1972 Japan .

*Primary Examiner*—Eugene R. LaRoche
*Attorney, Agent, or Firm*—Oblon, Fisher, Spivak, McClelland & Maier

[57] ABSTRACT

A fluorescent lamp device formed of an outer tube containing a fluorescent lamp therein, a connection tube connected to one end of the outer tube, a cap containing a glow starter and a condenser therein connected to the other end of the outer tube, and a base member connected to the connection tube. The base member contains a ballast member mainly formed of a thermistor and a thermal adjustment member having an integrally formed contacting member for making electrical connection with a base pin of the fluorescent lamp. The thermal adjustment member and the thermistor are in direct electrical and mechanical engagement such that the thermal adjustment member conducts heat from the thermistor to the thermal adjustment member.

9 Claims, 7 Drawing Figures

FLUORESCENT LAMP DEVICE

BACKGROUND OF THE INVENTION

1. Field of the Invention

This invention relates generally to a fluorescent lamp device, and more particularly to such a device having an incandescent lamp base.

2. Description of the Prior Art

A fluorescent lamp is widely used for its lighting efficiency in comparison with an incandescent lamp. So it is advantageous to use a fluorescent lamp instead of an incandescent lamp from the standpoint of electric power consumption in times of a severe energy crisis.

However, a fluorescent lamp generally has a straight or annular shape and has its own shaped base at its opposite ends. Also it is generally necessary to provide a glow starter and a ballast to light a fluorescent lamp. Consequently, a fluorescent lamp cannot typically be directly coupled to an incandescent lamp base.

Although there have been a few proposed fluorescent lamp devices having an incandescent lamp base, for example shown in U.S. Pat. No. 3,953,761, in such a fluorescent lamp device, the ballast is large and is disposed in the center of the device. As a result, it is difficult if not impossible to dispose a conventional ballast of large size in an incandescent lamp base. However, if a ballast were made small and lightweight it would be possible to dispose such a ballast in an incandescent lamp base.

A small and lightweight ballast is known using a positive characteristic thermistor as disclosed in Japanese Utility Model No. 1018720. However, such a thermistor ballast has a tendency to increase its resistance value as its temperature rises. Thus, as such a ballast is heated to a predetermined temperature, its resistance value rapidly becomes large. However, as the ballast resistance increases the lamp soon stops lighting since it is not possible to supply the lamp filaments with enough current to maintain electric discharge. Therefore, the use of such a thermistor ballast alone, without taking other measures, is not feasible in a fluorescent lamp device.

SUMMARY OF THE INVENTION

Accordingly, one object of this invention is to provide a small and compact fluorescent lamp device having an incandescent lamp base.

Another object of this invention is to provide a fluorescent lamp device employing a positive characteristic thermistor.

Yet another object of this invention is to provide a fluorescent lamp device having a thermal adjustment member connected to the thermistor.

A further object of this invention is to provide a fluorescent lamp device including a thermal adjustment member provided with a contacting member coupled to the base pin of the fluorescent lamp.

Yet another object of this invention is to provide a fluorescent lamp device which is simple in design, easy to manufacture and efficient and reliable in operation.

These and other objects have now been achieved according to this invention by providing a new and improved fluorescent lamp device including a cylindrical outer tube, a fluorescent lamp device disposed in the outer tube and having a base at each end thereof, a cylindrical connection tube connected to one end of the outer tube, a cap containing a glow starter and a condenser fixed to the other end of the outer end of the outer tube, a base member fixed to the connection tube, and a ballast member formed of a thermistor, a conductive plate, a thermal adjustment member and a coil spring disposed in the base member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
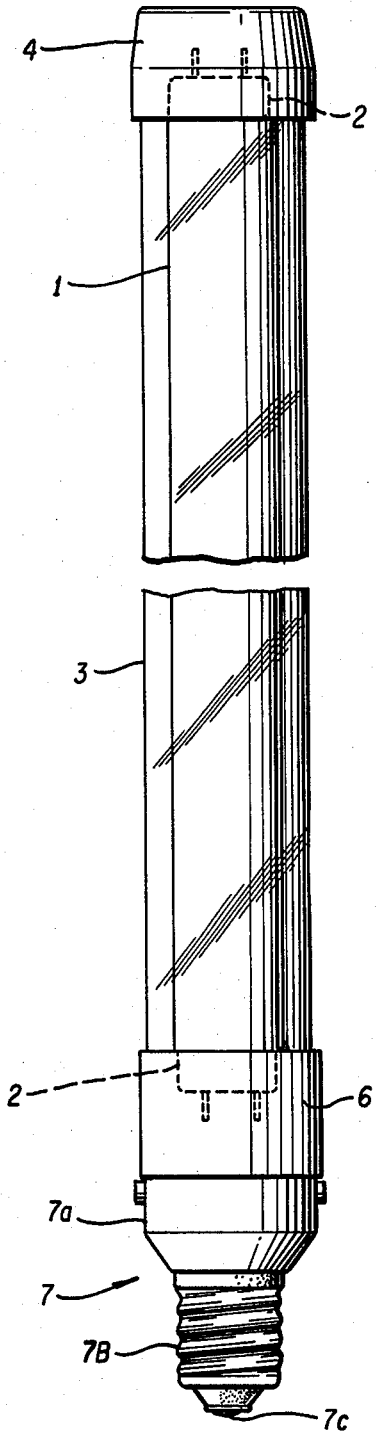
FIG. 1 is a schematic elevational view of a fluorescent lamp device constructed in accordance with the present invention.
Figure 2:
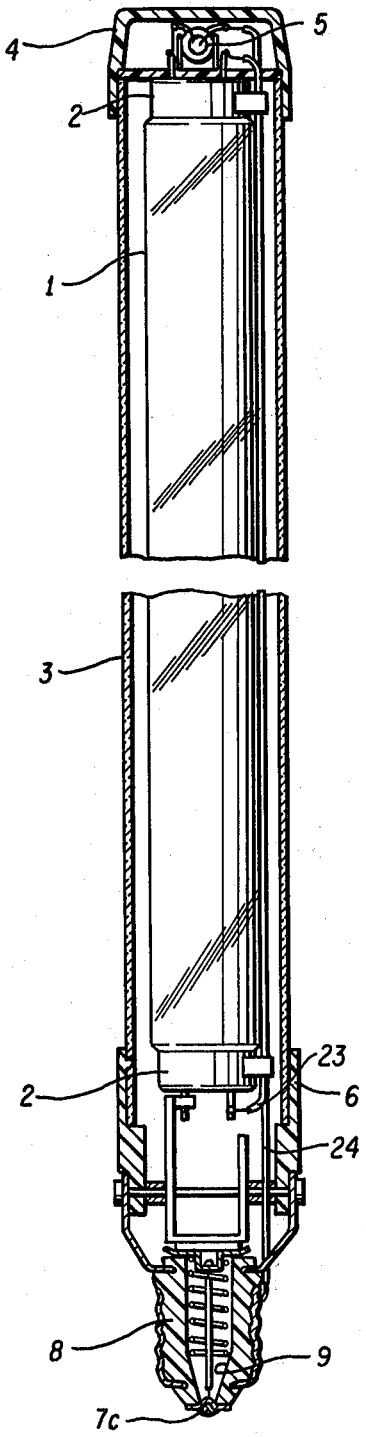
FIG. 2 is a cross-sectional view of the device shown in FIG. 1.

Referring now to the drawings, wherein like reference numerals designate identical or corresponding parts through the several views, and more particularly to FIG. 1 and FIG. 2 thereof, a fluorescent lamp 1 provided with base 2, at both ends thereof is disposed in a cylindrical outer tube 3 made of transparent polycarbonate resin. A cap 4 is provided at one end of the outer tube 3 and a glow starter 5 is contained therein. At the other end of the outer tube 3 is provided a connection tube 6 which connects the outer tube 3 and a base member 7. The base member 7 is an Edison type screw base and consists of a cylindrical straight part 7*a*, screw part 7*b*, and a terminal part 7*c*. An insulating material 8 is provided as a lining in the screw part 7*b*, such that there is formed a hollow 9 surrounded with the insulating material 8 leading to the terminal part 7*c*.

Figure 3:
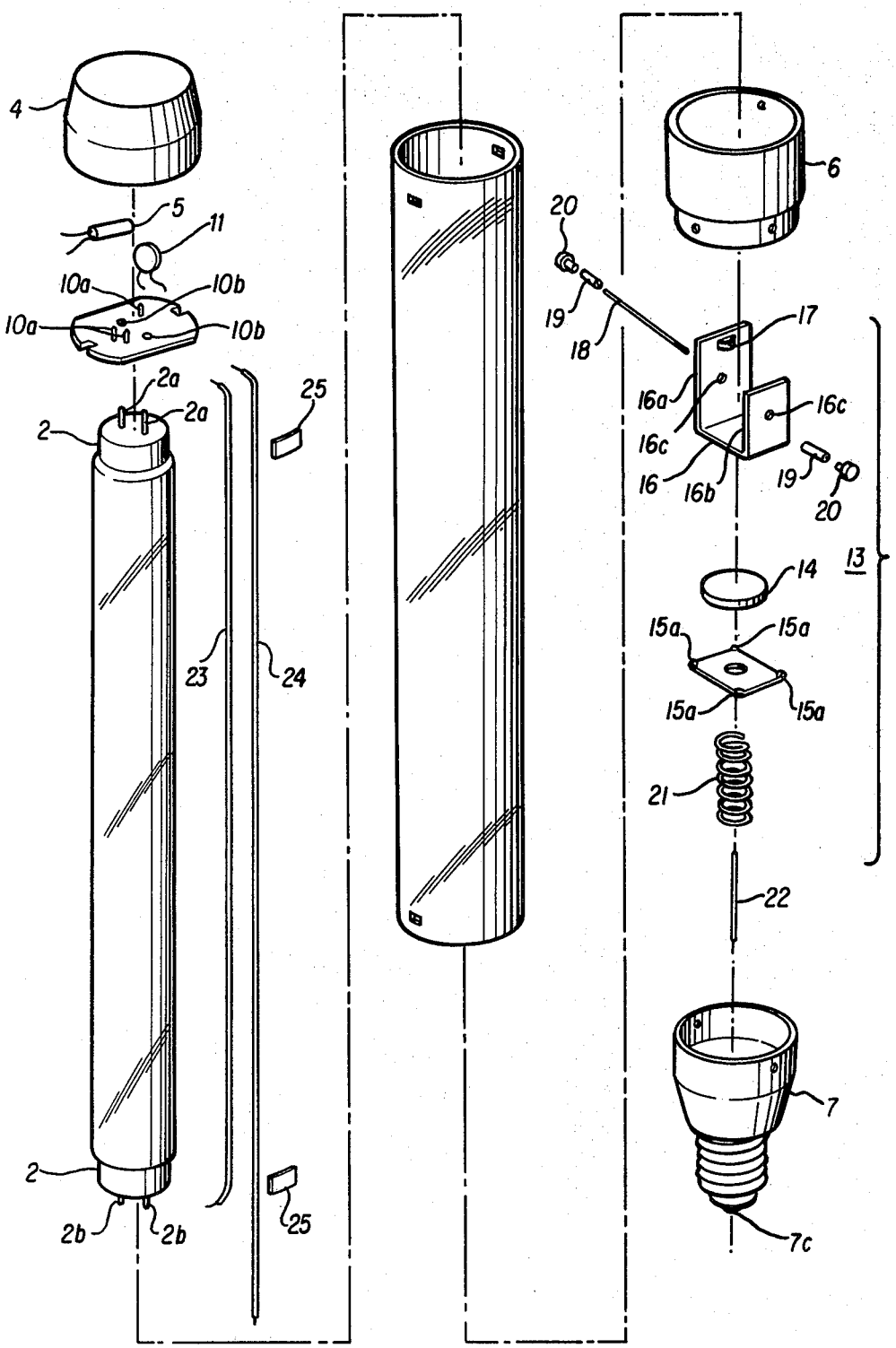
FIG. 3 is an exploded perspective view of a fluorescent device constructed in accordance with the present invention.

Referring FIG. 3, reference numeral designation 10 refers to a holding plate having projections 10*a*, which hold the glow starter 5 and a condenser 11. Plate 10 is provided with holes 10*b*, 10*b* in which are fixed the base pins 2*a*, 2*a* of lamp 1.

Located within the base member 7 is a thermistor 14, which is sandwiched between a conductive plate 15 and a thermal adjustment member 16. The conductive plate 15 is made of copper plated with nickel and has four upturned corners 15*a*, . . . at each corner thereof to stop lateral movement of the thermistor 14. The thermal adjustment member 16 is made of a heat conduction material such as aluminium and is formed U-shaped. The thermal adjustment member 16 includes a contacting member 17 which is connected with a base pin 2*b* of the fluorescent lamp 1. Namely this contacting member 17 is formed by cutting up a part of one of a standing side 16*a* of member 16. Moreover, there is formed a hole 16*c* through each standing sides 16*a*, 16*b* and a supporting bar 18 is provided penetrating through the holes 16*c*, 16*c*. Both ends of the supporting bar 18 are fixed in insulating spacer tubes 19, 19. The supporting bar 18 is inserted through the connection table 6 and the straight part 7*a* and is fixed by fixtures 20, 20.

Reference numeral designation 21 refers to a coil spring disposed in the hollow 9. The top part of the spring 21 is in contact with and pushes against the conductive plate 15 by the spring action of the spring 21. Reference numeral designation 22 refers to a copper lead wire which electrically connects the conductive plate 15 and the terminal part, part 7*c*. Then vinyl coated conductors 23, 24 are disposed along the surface of the fluorescent lamp 1.

Conductor 23 connects electrically one pair of opposed base pins 2*a* and 2*b* at opposite ends of the fluorescent lamp 1. The other conductor 24 electrically connects the lead wires of the glow starter 5, the condenser 11 and the base member 7. The conductors 23–24 are attached by a tape for example, an adhering tape 25 at the base 2, 2.

Figure 4:
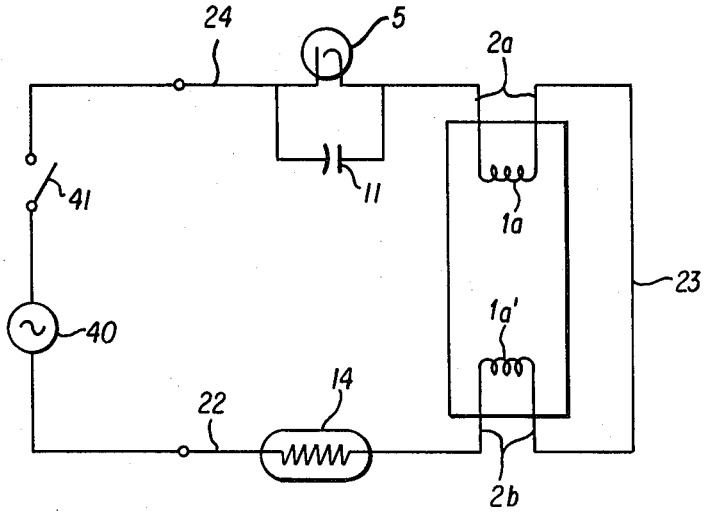
FIG. 4 is a schematic diagram of electric circuit embodying the present invention.

FIG. 4 is a schematic diagram of an electric circuit using such a fluorescent lamp device. Namely filaments 1*a* and 1*b* of the fluorescent lamp 1 are connected in series with the thermistor 14 and the parallel combination of the glow starter 5, and the condenser 11. The filament 1*b* of the fluorescent lamp 1 is connected to the power source 40 via thermistor 14, while the filament 1*a* is connected to the switch 41 via the parallel connected glow starter 5 and the condenser 11.

In such an electric circuit when the switch 41 is closed, a current flows through the filaments 1*a*, 1*b* and the glow starter 5. So, owing to the well known operation of the glow starter 5, the fluorescent lamp 1 begins to light. After lighting, the lamp exhibits a well known negative current-voltage characteristic. But the fluorescent lamp 1 itself cannot control the increase of the lamp current. To control the lamp current it is necessary to include the thermistor 14.

Figure 5:
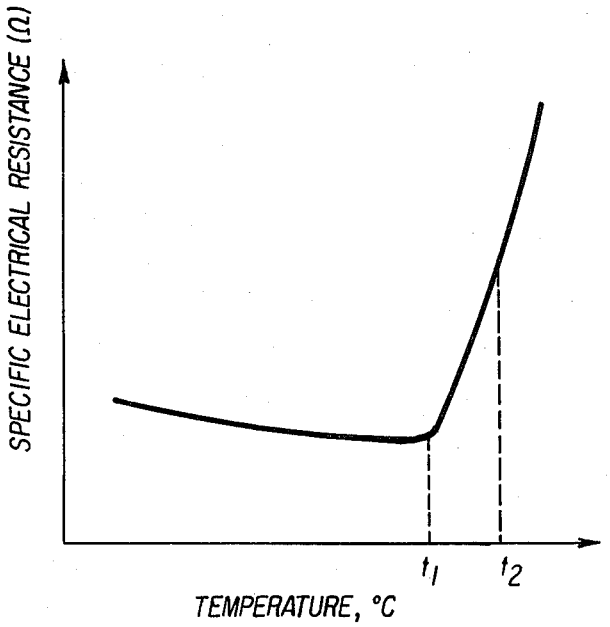
FIG. 5 is a graph illustrating the relation between the temperature and the resistance value of the thermistor.

When using this thermistor 14, immediately after lighting the resistance value of the thermistor 14 is low because the temperature of the thermistor 14 is low. So there then flows a large current through the filament 1*a*, 1*b*, and it is easy to maintain discharge of the fluorescent lamp 1 because the amount of the electron emission released from the filament 1*a*, 1*b* increases. During this time the thermistor 14 is heated and its temperature maintained between $t_1$° C.~$t_2$° C. as shown in FIG. 5. Consequently, stable lighting of the fluorescent lamp 1 continues. But when the value of the power source voltage rises the current value also rises, such that the thermister 14 is heated more and more and finally its temperature exceeds $t_2$° C. In such a case the lighting of the fluorescent lamp will soon stop because the current flowing through the filaments 1*a*, 1*b* becomes small because the resistance value of thermistor 14 becomes large.

However, according to present invention, the thermal adjustment member 16 providing a contacting member 17 connected with the base pin 2*b* of the fluorescent lamp 1, is connected to the thermistor 14, such that if the thermistor 14 is heated above the predetermined temperature, excess heat from the thermistor 14 is conducted to the thermal adjustment member 16, which radiates the heat from its large surface area.

On account of the existence of the thermal adjustment member 16, the temperature of the thermistor 14 is always maintained below the predetermined temperature $t_2$° C. Consequently the resistance value of the thermistor 14 is always maintained at a desirable value, so that stable lighting of the fluorescent lamp 1 is maintained.

Moreover as the contacting member 17 is formed by cutting up a part of standing side 16*a* of the thermal adjustment member 16, by merely inserting the base pin 2*b*. One end of the fluorescent lamp 1 is supported mechanically by the thermal adjustment member 17.

Furthermore, the electrical connection between the base pin 2*b* and the therminal 7*c* of the base member 7 is accomplished simply by inserting the base pin 2*b* into the contacting member 17 of the thermal adjustment member 16.

Additionally, the conductive plate 15 is always being pushed upwardly by the coil spring 21, so the thermistor 14 is also being pushed upwardly, to achieve a firm mechanical connection between the thermistor 14 and the thermal adjustment member 16 and thereby assure thermal conduction from the thermistor 14 to the thermal adjustment member 17.

Figure 6:
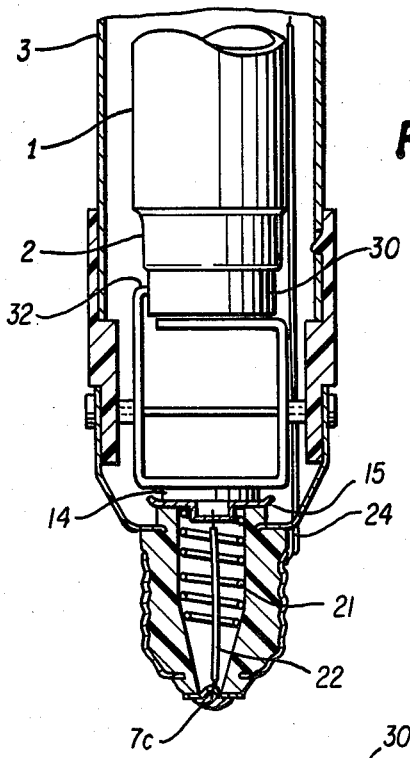
FIG. 6 is an expanded cross-sectional view of another embodiment of the device of the present invention.
Figure 7:
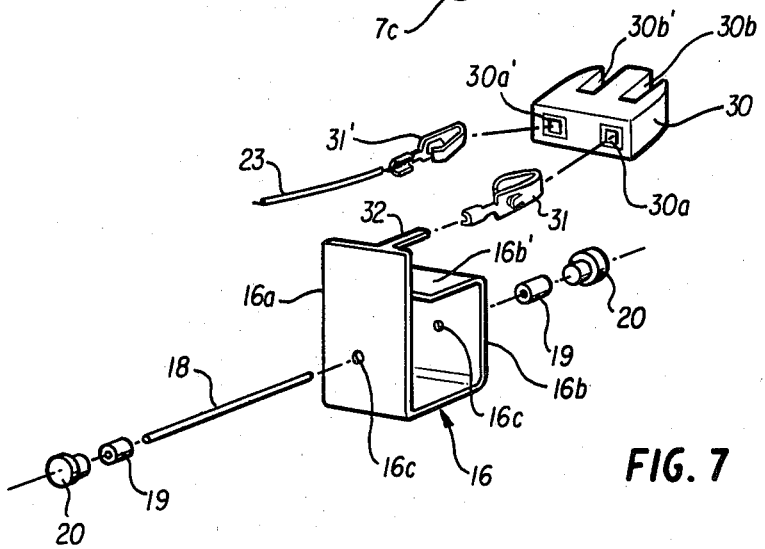
FIG. 7 is a partially exploded view of the device shown in FIG. 6.

FIG. 6 and FIG. 7 show another embodiment of the invention. This embodiment employs an insulating socket 30 as a contacting member, provided with a thermal adjustment member 16. Namely, the socket body 30 is made of an insulating material such as plastic and has two penetration holes 30*a* and 30*a*'. About over half the length of each of holes 30*a*, 30*a*' there are provided respective slot openings 30*b*, 30*b*'. Conductive terminals 31, 31' made of brass screws are contained in the holes 30*a*, 30*a*'.

So an electrical contact of the fluorescent lamp 1 and the socket body 30 is done by inserting each of base pins 2*b*, 2*b* of the fluorescent lamp 1 into respective slot openings 30*b*, 30*b*'.

On the other hand, electrical contact of the socket body 30 and the thermal adjustment member 16 is done by inserting a projection 32 integrally formed at the top of the standing side 16*a* of the thermal adjustment member 16 into hole 30*a*. The other hole 30*a*' having conductive terminal 31' is connected to the conductor 23. The socket body 30 is mounted on the bent portion 16*b*'. The remaining elements numbered are the same as in FIG. 3. In such a construction, the thermal adjustment member 16 is electrically and mechanically coupled to the one end of the fluorescent lamp 1 via the socket 30. Consequently, no special supporting member for supporting the fluorescent lamp 1 is necessary, and no conducting member for connecting the thermal adjustment member 16 and the base pin 2*b* is necessary, which is distinctly advantageous.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A fluorescent lamp device comprising:

a cylindrical outer tube;

a fluorescent lamp having a base at each end thereof disposed in said outer tube, each base having a pair of pins protruding therefrom for making connection thereto;

a cylindrical connection tube connected to one end of said outer tube;

a cap containing a glow starter and a condenser, said cap fixed to the other end of said outer tube;

a base member fixed to said connection tube; and a ballast member comprising a thermistor, a conductive plate, a thermal adjustment member and a coil spring disposed in said base member.

2. A fluorescent lamp device as in claim 1, wherein said thermistor and said thermal adjustment member are in contacting electrical and mechanical engagement.

3. A fluorescent lamp device as in claims 1 or 2, wherein said thermistor comprises:

a positive temperature characteristic thermistor.

4. A fluorescent lamp device as in claims 1 or 2, wherein said thermal adjustment member comprises:

an integrally formed contacting member for making electrical connection with a selected base pin of the fluorescent lamp.

5. A fluorescent lamp device as in claim 4, wherein said contacting member is formed on a standing side of the thermal adjustment member.

6. A fluorescent lamp device as in claim 4 further comprising:

a supporting bar penetrating said thermal adjustment member, said connection tube, and said base member for making a mechanical connection therebetween.

7. A fluorescent lamp device as in claim 5, further comprising:

a supporting bar penetrating said thermal adjustment member, said connection tube, and said base member for making a mechanical connection therebetween.

8. A fluorescent lamp device as in claim 4, wherein said contacting member comprises:

a socket mounted on a bent portion of a standing side of the thermal adjustment member.

9. A fluorescent lamp device as in claim 8 wherein said contacting member of said thermal adjustment member comprises:

a projection for making an electrical connection with the socket.

* * * * *